US011666122B2

(12) United States Patent
Simpson et al.

(10) Patent No.: US 11,666,122 B2
(45) **Date of Patent: *Jun. 6, 2023**

(54) SECURE FIT QUICK RELEASE TOOL BELT AND SYSTEMS AND METHODS FOR USE

(71) Applicant: TRU-FIT BELTS, LLC, Urbandale, IA (US)

(72) Inventors: Joseph Ray Simpson, Urbandale, IA (US); James Nelson, Carlisle, IA (US)

(73) Assignee: TRU-FITS BELTS, LLC, Urbandale, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/717,885

(22) Filed: Apr. 11, 2022

(65) Prior Publication Data

US 2022/0232931 A1 Jul. 28, 2022

Related U.S. Application Data

(63) Continuation of application No. 17/181,816, filed on Feb. 22, 2021, now Pat. No. 11,297,907, which is a (Continued)

(51) Int. Cl.

| | |
|---|---|
| ***A44B 11/12*** | (2006.01) |
| ***A45F 3/14*** | (2006.01) |
| ***A41F 9/00*** | (2006.01) |

(52) U.S. Cl.

CPC ..... *A44B 11/125* (2013.01); *A41F 9/002* (2013.01); *A45F 2003/144* (2013.01)

(58) Field of Classification Search

CPC ..... A44B 11/125; A45F 2003/144; Y10T 24/2183; Y10T 24/2106; Y10T 24/216; A41F 9/02; A41F 9/002

(Continued)

(56) References Cited

U.S. PATENT DOCUMENTS

| | | | |
|---|---|---|---|
| 2,802,248 | A | 8/1957 | Wallace |
| 3,662,435 | A | 5/1972 | Allsop |

(Continued)

OTHER PUBLICATIONS

International Searching Authority, "Search Report and Written Opinion," issued in connection with International Patent Application No. PCT/US2017/035597, dated Aug. 31, 2017, 6 pages.

(Continued)

*Primary Examiner* — Justin M Larson

(74) *Attorney, Agent, or Firm* — Nyemaster Goode P.C.

(57) ABSTRACT

Disclosed is a quick release tool belt for the waist of a user, which includes a support strap, a release band with belt teeth on a first end and a binding with a release mechanism on the second end and slidably coupled to the release band. The binding has a base, a release rotationally attached to the base with a tooth lock, a tooth coupling rotationally attached to the base and engaged with the release and the release band, and a lever rotationally attached to the release and engaged with the release band with a tightening tooth. When the release is in the engaged position the tooth coupling and the lever are engaged with the release band and when the release is in the release position, the tooth coupling is operably engaged with the release and the tooth coupling and the lever are disengaged with the release band.

20 Claims, 6 Drawing Sheets

Related U.S. Application Data continuation of application No. 16/302,518, filed as application No. PCT/US2017/035597 on Jun. 2, 2017, now Pat. No. 10,952,509.

(60) Provisional application No. 62/345,455, filed on Jun. 3, 2016.

(58) Field of Classification Search
USPC ..... 24/68 SK, 70 SK, 71 SK
See application file for complete search history.

(56) References Cited

U.S. PATENT DOCUMENTS

| | | | |
|---|---|---|---|
| 4,747,527 | A | 5/1988 | Trumpower, II |
| 5,416,952 | A | 5/1995 | Dodge |
| 5,572,747 | A | 11/1996 | Cheng |
| 5,588,186 | A | 12/1996 | Ko |
| 5,606,779 | A | 3/1997 | Lu |
| 5,745,959 | A | 5/1998 | Dodge |
| 5,779,259 | A | 7/1998 | Lin |
| 6,175,994 | B1 | 1/2001 | Nicoletti |
| 6,315,179 | B1 | 11/2001 | Hillis |
| 6,554,297 | B2 | 4/2003 | Phillips et al. |
| 6,748,630 | B2 | 6/2004 | Livingston |
| 7,086,122 | B2 | 8/2006 | Livingston |
| 7,575,136 | B2 | 8/2009 | Kernkamp |
| 7,877,845 | B2 | 2/2011 | Signori |
| 8,763,209 | B2 | 7/2014 | Kavarsky et al. |
| 8,763,210 | B2 | 7/2014 | Vincent et al. |
| 9,332,798 | B2 | 5/2016 | Gafforio et al. |
| 9,351,526 | B1 | 5/2016 | Taylor |
| 9,351,539 | B2 | 5/2016 | Briggs |
| 10,070,701 | B1 | 9/2018 | Liu |
| 10,238,183 | B1 | 3/2019 | Taylor |
| 10,794,664 | B1 | 10/2020 | Moreno |
| 10,952,509 | B2 | 3/2021 | Simpson et al. |
| 11,297,907 | B2 * | 4/2022 | Simpson ..... B25H 3/00 |
| 2001/0013157 | A1 | 8/2001 | Giancarlo |
| 2002/0000707 | A1 | 1/2002 | Couderc |
| 2002/0189056 | A1 | 12/2002 | Gallina et al. |
| 2006/0053531 | A1 | 3/2006 | McBride et al. |
| 2009/0178256 | A1 | 7/2009 | Toth |
| 2010/0162539 | A1 | 7/2010 | Rancon |
| 2012/0297591 | A1 | 11/2012 | Bozzetto et al. |
| 2013/0047388 | A1 | 2/2013 | Kavarsky et al. |
| 2013/0091674 | A1 | 4/2013 | Chen |
| 2015/0359542 | A1 | 12/2015 | Steinbaugh et al. |
| 2016/0135547 | A1 | 5/2016 | Kuffrey et al. |
| 2019/0200711 | A1 | 7/2019 | Simpson et al. |
| 2021/0169181 | A1 | 6/2021 | Simpson et al. |

OTHER PUBLICATIONS

International Searching Authority, "International Preliminary Report on Patentability," issued in connection with International Patent Application No. PCT/US2017/035597, dated Dec. 4, 2018, 5 pages.

* cited by examiner

SECURE FIT QUICK RELEASE TOOL BELT AND SYSTEMS AND METHODS FOR USE

CROSS-REFERENCE TO RELATED APPLICATION

This application is a Continuation of and claims priority to U.S. patent application Ser. No. 17/181,816, filed on Feb. 22, 2021, entitled "SECURE FIT AND QUICK RELEASE BELT AND SYSTEMS AND METHODS FOR USE," which application is a Continuation of and claims priority to U.S. patent application Ser. No. 16/302,518, filed Jun. 2, 2017, entitled "SECURE FIT AND QUICK RELEASE BELT AND SYSTEMS AND METHODS FOR USE," which is a National Stage Entry of PCT Application No. PCT/US2017/035597, filed Jun. 2, 2017, entitled "SECURE FIT AND QUICK RELEASE BELT AND SYSTEMS AND METHODS FOR USE," which application claims priority to U.S. Provisional Patent Application No. 62/345,455, filed on Jun. 3, 2016, entitled "SECURE FIT AND QUICK RELEASE BELT AND SYSTEMS AND METHODS FOR USE," the disclosures of which are hereby incorporated by reference in its entirety.

BACKGROUND

The present invention relates to an improved tool belt. One aspect of the present invention is a tool belt that provides for an easily adjusted, secure fit. Another aspect of the present invention is a system for adjusting or tightening the tool belt. Another aspect of the present invention is a quick release for easily removing the tool belt.

In another embodiment, disclosed is a tool belt system having a support strap having a first end and a second end, a release band disposed at the first end, and a base coupled to the second end. A release is rotationally attached to the base and having a first position and a second position and comprising a tooth lock, a tooth coupling rotationally attached to the base and operably engaged with the release and the release band, a lever rotationally attached to the release and operably engaged with the release band, and comprising at least one tightening tooth. When the release is in the first position the tooth coupling and the lever are engaged with the release band and allow for slidable movement in a tightening direction and prevent movement in a loosening direction, and when the release is in the second position, the tooth coupling is operably engaged with the release and the tooth coupling and the lever are disengaged with the release band and allow for movement in both the tightening and loosening directions.

Typically, a tool belt has a belt and buckle, although the belt and buckle may be made of a variety of materials with varying durability. The conventional buckle is similar to closures that are available on other standard belts. This limits the available sizes and adjustment options, however. It also requires the buckle to be unfastened in order to make even a minor adjustment. Thus, there is a need for a better, more secure tool belt that can be easily and quickly adjusted. There also remains a need for a tool belt that can be quickly released. In cold climates, this may be important as workers may be wearing numerous layers of clothing which shift and constant re-adjustment of the belt is burdensome and time-consuming. In certain applications such as weight-lifting, a user may wish to loosen the belt after each set, and quickly re-tighten just before starting the next set of lifts.

The present invention relates generally to an improved tool belt and in particular, to the devices, methods, and design principles of tool belt that can be easily adjusted and quickly removed for use in various applications, such as a construction tool belt system, a law enforcement belt, a weight lifting belt, a military belt, or a cable/telephone repair belt, or any other type of work that requires tools weighing approximately 30-50 pounds or more to be attached to a user's waist for easy access during work duties.

SUMMARY

In a first embodiment, disclosed is a quick release tool belt for the waist of a user, which includes a support strap, a release band with belt teeth on a first end and a binding with a release mechanism on the second end and slidably coupled to the release band. The binding has a base, a release rotationally attached to the base with a tooth lock, a tooth coupling rotationally attached to the base and engaged with the release and the release band, and a lever rotationally attached to the release and engaged with the release band with a tightening tooth. When the release is in the engaged position the tooth coupling and the lever are engaged with the release band and when the release is in the release position, the tooth coupling is operably engaged with the release and the tooth coupling and the lever are disengaged with the release band.

In another embodiment, disclosed is a belt system having a support strap with a first end and a second end, a release band at the first end, and a base coupled to the second end. The belt may further have a release rotationally attached to the base and having a first position and a second position with a tooth lock, a tooth coupling rotationally attached to the base and operably engaged with the release and the release band, and a lever rotationally attached to the release and operably engaged with the release band, and comprising at least one tightening tooth. When the release is in the first position the tooth coupling and the lever are engaged with the release band and allow for slidable movement in a tightening direction and prevent movement in a loosening direction. When the release is in the second position, the tooth coupling is operably engaged with the release and the tooth coupling and the lever are disengaged with the release band and allow for movement in both the tightening and loosening directions.

In another embodiment, disclosed is a method of tightening and loosening a tool belt, comprising the steps of providing a tool belt capable of holding a plurality tools weighing at least 30 pounds around the waist of a user, providing a release band on the belt, providing a binding operably engaged with the release band on the belt, sliding a first end of the release band through the binding, preventing the release band from loosening by providing a plurality of teeth within the binding and the on the release band that allow for relative sliding movement in a tightening direction around the user, and prevent relative sliding movement in a loosening direction around the user. Then tightening the belt incrementally by rotating an elongate lever on the binding, forcing incremental sliding movement in a tightening direction between the binding and the release band. Then loosening the belt by rotating a release away from the release band, thereby disengaging the plurality of teeth within the binding and on the release band and allowing for relative movement in both the tightening and loosening directions between the binding and the release band.

DETAILED DESCRIPTION

Discussed herein are various embodiments, systems and methods relating to an improved tool belt. For brevity, these embodiments may be described in relation to a "tool belt" or "belt" though that is not intended to limit the scope of the disclosure in any way. For instance, the present invention can be used in carpentry, construction, and other applications beyond those described herein, including belt applications that require a secure fit with this ability to hold items that may have a lot of weight or mass and would benefit from the advantages of the present invention.

Figure 1:
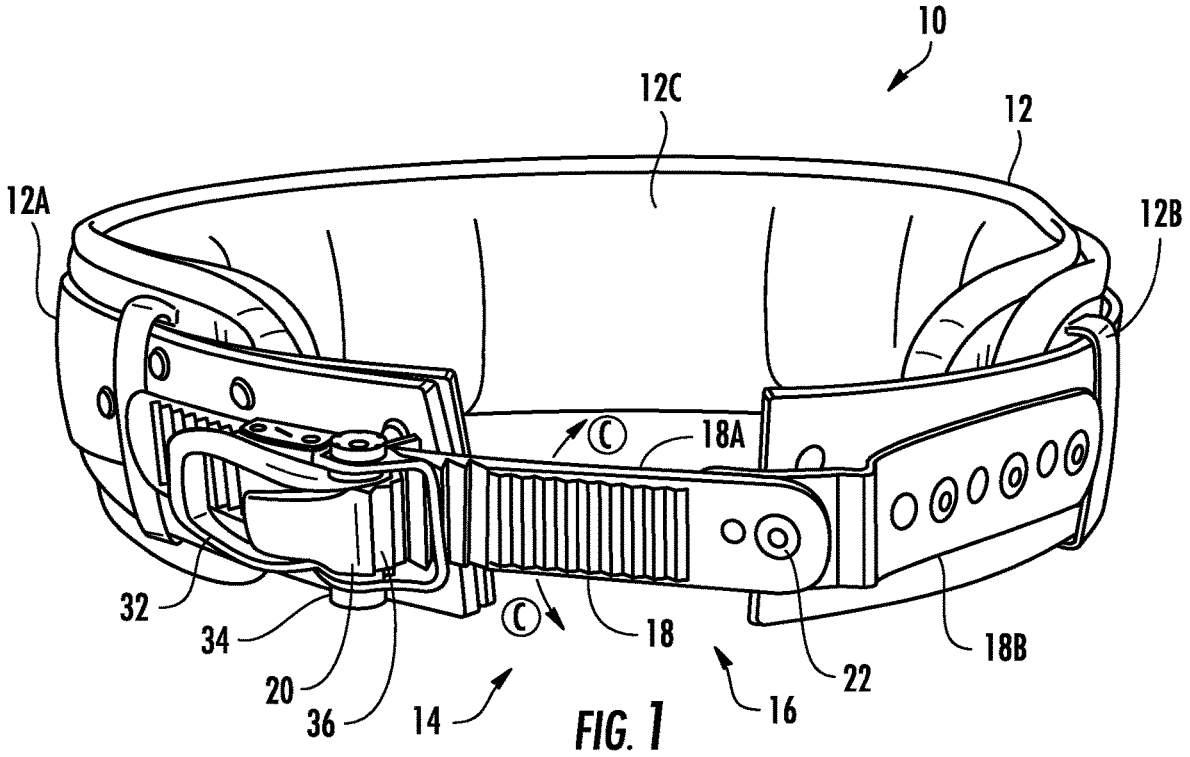
FIG. 1 depicts an isometric view of a quick release tool belt of an embodiment.

As best shown in FIG. 1, the belt 10 has a C-shaped support strap 12 having a strap opening 14 and quick release assembly 16. In various implementations, the strap 12 is secured around the waist of a user by tightening a quick release assembly 16.

In various implementations, the support strap 12 has a side portion 12A and another side portion 12B and the various components of the quick release assembly 16 can be disposed or otherwise arranged variously on the side portions 12A, 12B. It is understood that in certain implementations, the support strap 12 can have support padding 12C or other comfort and support features known in the art, such as foam or the like, disposed within the comparatively rigid side portions 12A, 12B.

Figure 2:
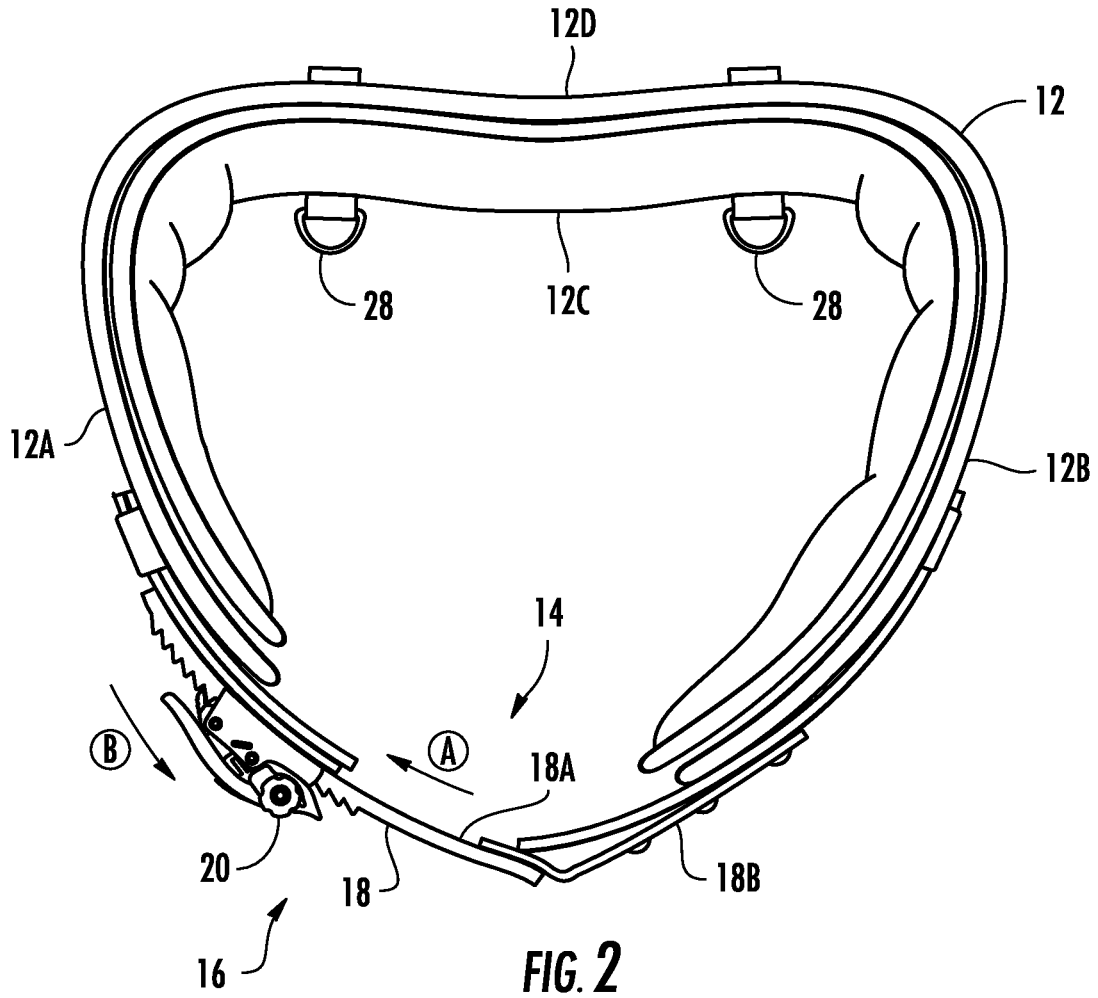
FIG. 2 is a top view of a quick release tool belt of an embodiment.

In the implementations of FIGS. 1-2, the quick release assembly 16 has a release band 18 fixedly attached to a side portion 12B so as to be in slidable communication with a binding 20 disposed on the opposite side portion 12A.

Figure 4A:
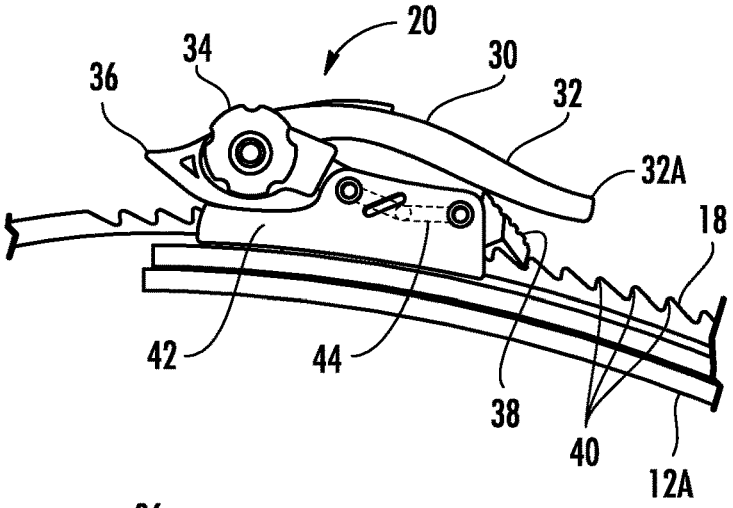
FIG. 4A-4C depict the various functional states of an embodiment of the quick release tool belt.
Figure 4B:
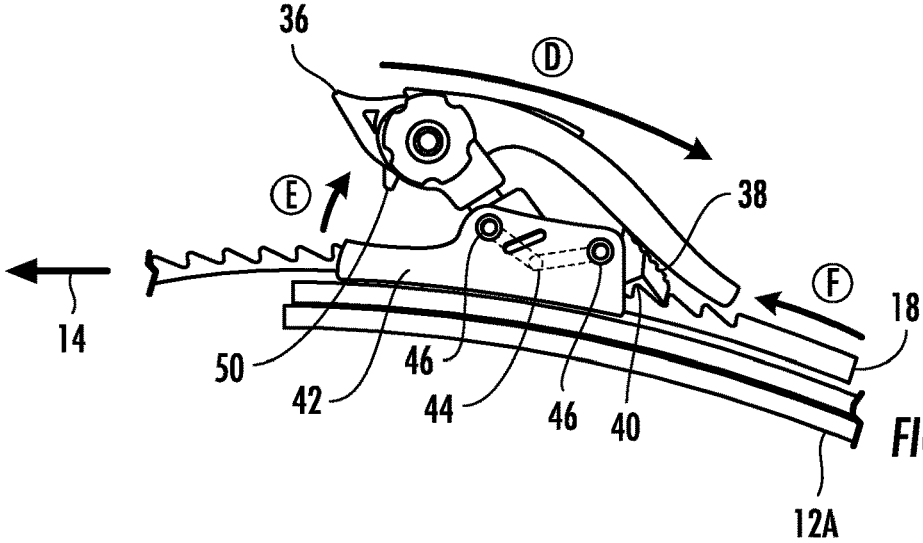
Figure 4C:
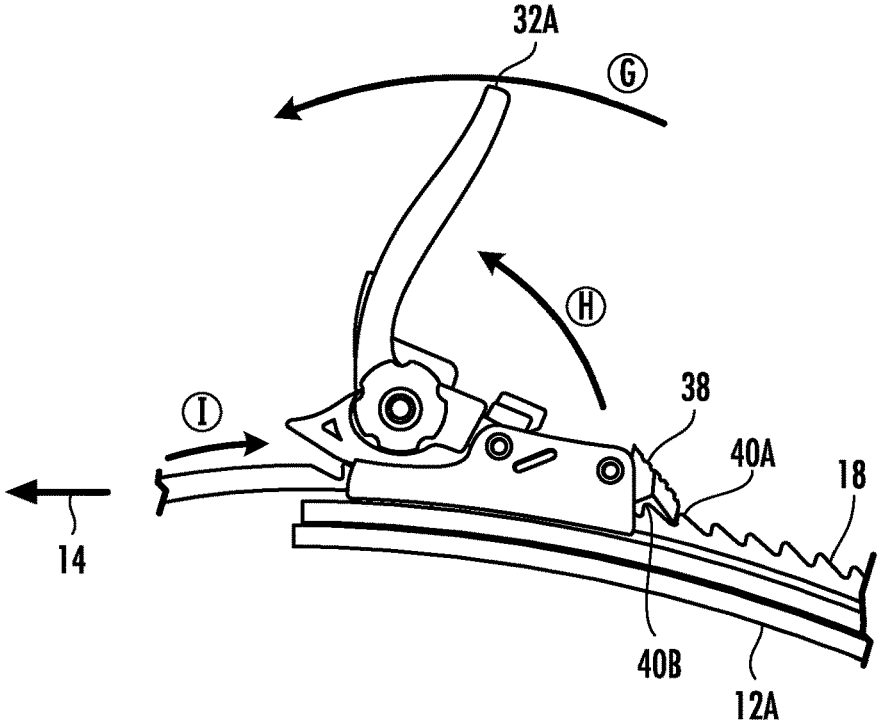

As best shown in FIG. 2, the C-shaped support strap 12 also has a back portion 12D, such that the user is enclosed within the belt 10, such that the slidable movement of the release band 18 (shown by reference arrows A and B) relative to the binding 20 can tighten or loosen the belt 10 around the user, as described further in relation to FIGS. 4A-C.

Figure 3:
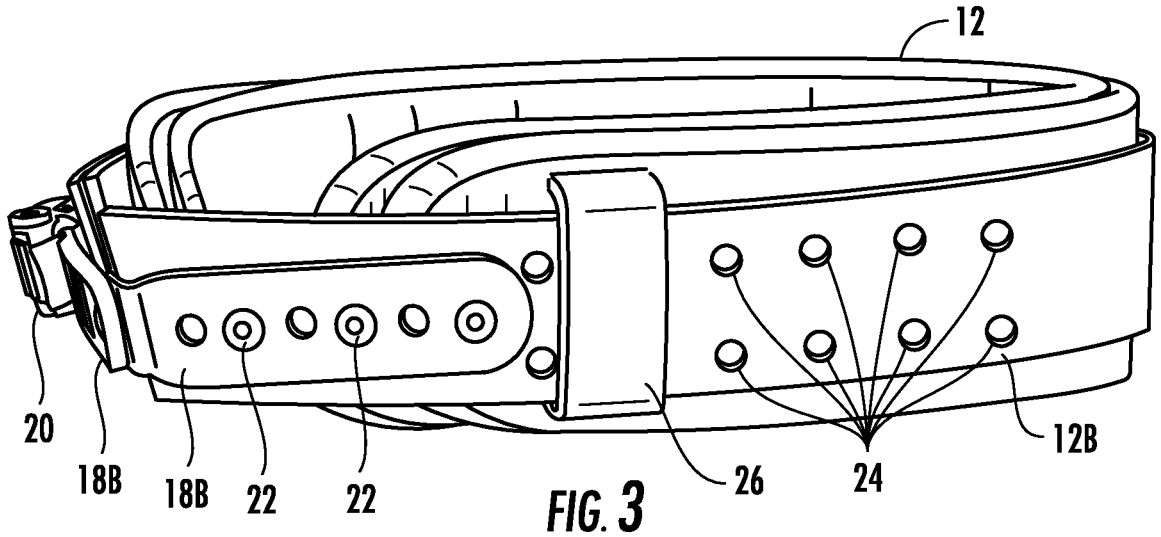
FIG. 3 is a side view of a quick release tool belt of an embodiment.

Turning to FIG. 3, a plurality of rivets or other fasteners 22 can be used to secure the release band 18 to the side portion 12B. In certain implementations, the release strap can comprise a plurality of elongate portions 18A, 18B that can rotate relative to one another by way of a single fastener 22 (best shown in FIG. 1 at reference arrow C). It is understood that in alternate implementations the release band 18 is a single elongate, non-rotatable structure and that further implementations are possible.

Returning to FIGS. 2-3, in various implementations of the belt, a plurality of strap openings 24, loops 26 and other attachments 28 can be provided to permit other adjustments and the attachment of various tools and other ancillary items used by the user of the tool belt 10. It is understood that many alternate configurations are possible.

As shown in the implementation of FIGS. 4A-C, the binding 20 generally has a tightening and release mechanism 30 mounted in a support housing 42. In this implementation, the tightening and release mechanism 30 is capable of both ratcheted driving and release functions, so as to be able to selectively tighten the belt 10 by engaging and urging the release band 18 through the binding 20 and housing 42, or in the alternative, releasing the release band 18 to allow it to freely pass through the binding 20 and housing 42 and quickly loosen the belt 10. It is understood that the binding 20 and tightening and release mechanism 30 have three states: tightening, locked, and release. During use, the tightening and release mechanism 30 may be configured to be preferentially be in the locked state shown in the implementation of FIG. 4A.

In various implementations, the tightening and release mechanism 30 comprises an elongate tightening lever 32 disposed across the binding 20 and in operable communication with a pivot 34. In various embodiments, the pivot 34 is also in operable communication with a release 36, which in the implementation of FIGS. 4A-C is disposed opposite the pivot 34 from the tightening lever 32, though other implementations are possible.

As also shown in the implementations of FIGS. 4A-4C, the tightening and release mechanism 30 also has a tooth coupling 38 adapted to be in operable communication with a plurality of teeth 40 disposed on the release band 18. In the various implementations of FIGS. 4A-C, the tightening lever 32 and release 36 are in operable communication with the tooth coupling 38 and are able to tighten or release the release band 18, respectively, for example by way of components in the support housing 42, such as an articulated joint 44, described further in relation to FIG. 4B.

As shown in FIG. 4B, a tooth lock 50 is also disposed on the "underside" of the pivot 34. It is understood that pivot 34 and tooth lock 50 are configured to be strongly urged toward the release band 18 in both the locked state of FIG. 4A and the tightening state of FIG. 4C. It is further understood that in exemplary implementations the tooth coupling 38 is also urged toward the teeth 40 in both the locked and tightening states.

Conversely, and returning to FIG. 4B, release of the release band 18 is best shown in the implementation of FIG. 4B, wherein the tooth lock 50 and tooth coupling 38 are selectively urged away from the teeth 40 so as to allow free sliding of the release band 18 relative to the tightening and release mechanism 30. In these implementations, upon urging the release 36 away from opening 14 (shown by reference arrow D) and the band 18 (reference arrow E), the pivot 34 is "raised" and the tooth lock removed from the teeth. Further, in certain implementations, the articulated joint 44 pivots between two end axles 46 around a central axle 48 so as to urge the tooth coupling 38 away from the teeth 40 and release the band 18 (reference arrow F). It is understood that in alternate embodiments, several other release mechanisms are possible.

Tightening of the belt 10 is shown in the implementation of FIG. 4C. In this implementation, the user is able to actuate the tightening lever 32 from a distal end 32A to rotate it about the pivot 34 (as shown by reference arrows G and H). In this implementation, the tightening and release mechanism 30 urges the teeth 40 away from the strap opening 14 by way of the tooth coupling 38, thereby tightening the belt 10 (reference arrow I). In these implementations, the tooth lock 50 is "loosened" with each pulling of the lever 32, so as to allow the incremental "tightening" of the belt, such that the tooth coupling 38 is able to be disposed adjacent successive teeth 40A, 40B. It is understood that in alternate embodiments, several other tightening mechanisms are possible.

Another embodiment is shown in FIGS. 5-9. In an embodiment, a release 136 may include a pawl 137 that corresponds to a shelf 139 on the tooth coupling 138. In this embodiment, instead of the axles 46 and articulated joint 44, when a user articulates the release 136 away from the release band 18, the release 136 is rotated around the axis 150 from a home or first position to a release or second position, and the pawl 137 is rotated toward the release band 18. The pawl 137 then contacts the ledge or shelf 139, forcing it toward the release band 18 as well, and the tooth coupling 138 is rotated about axis 152. As the tooth coupling 138 is rotated about axis 152, the tooth lock 140 is removed from coupling or engagement with the teeth 40 of the release band 18, and the release band 18 may be removed from the binding 120, allowing for quick and easy removal of the belt from the user.

Figure 5:
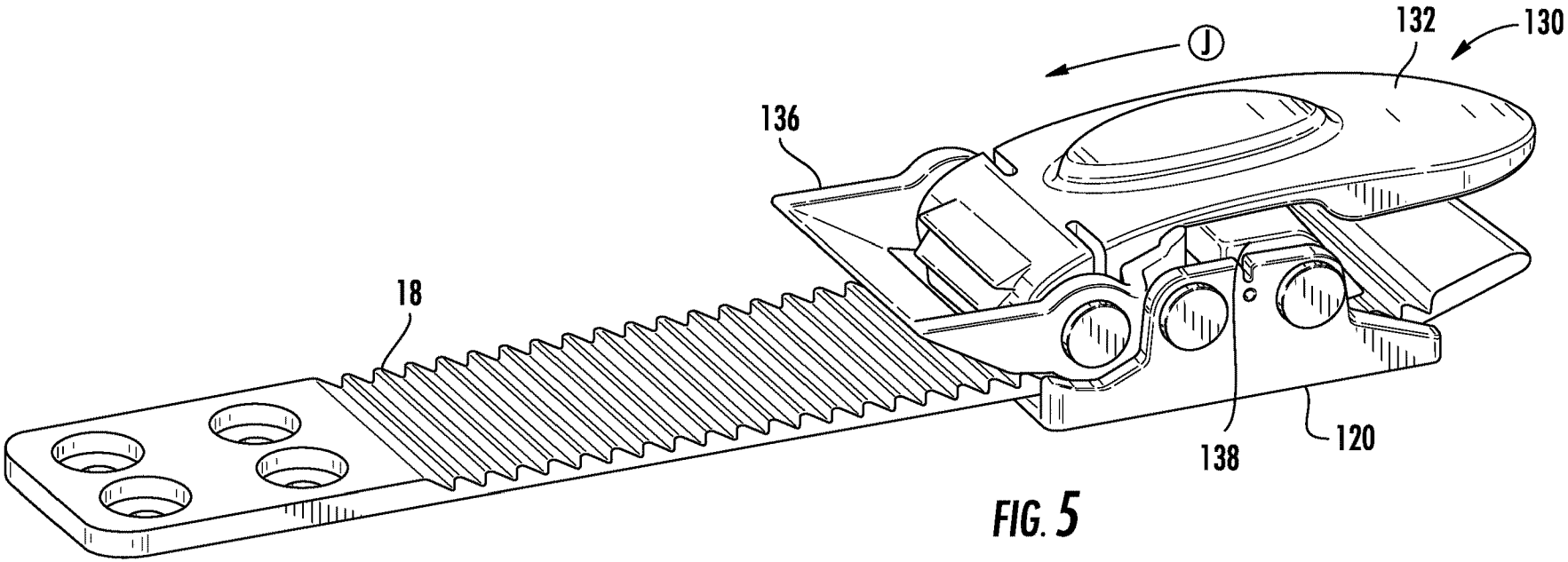
FIG. 5 is an isometric view of the release belt and binding of an embodiment of the quick release toolbelt.
Figure 6:
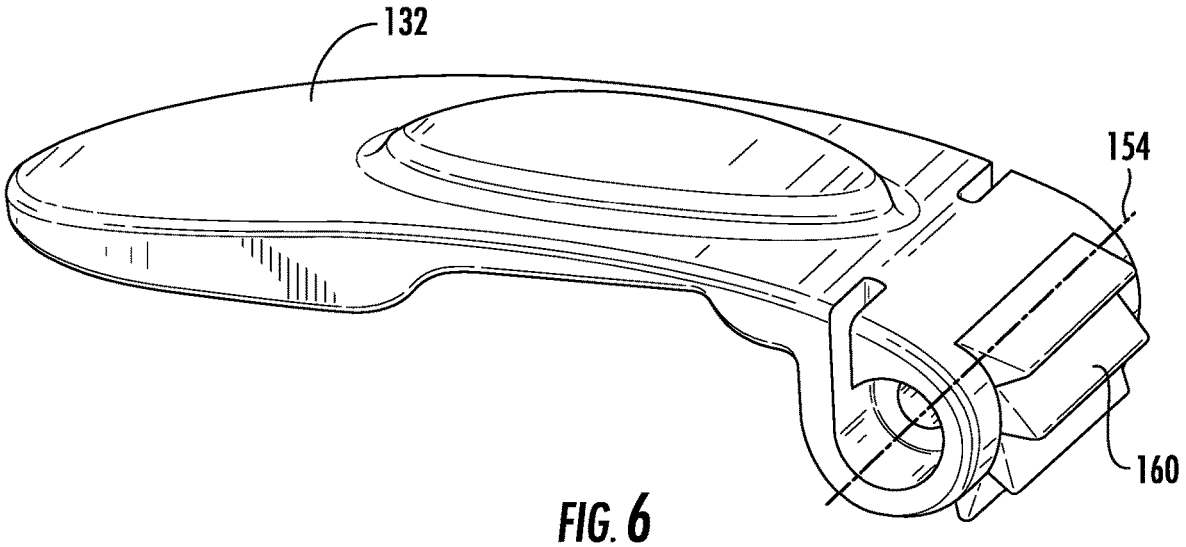
FIG. 6 is an isometric view of a lever of an embodiment of the quick release toolbelt.
Figure 7:
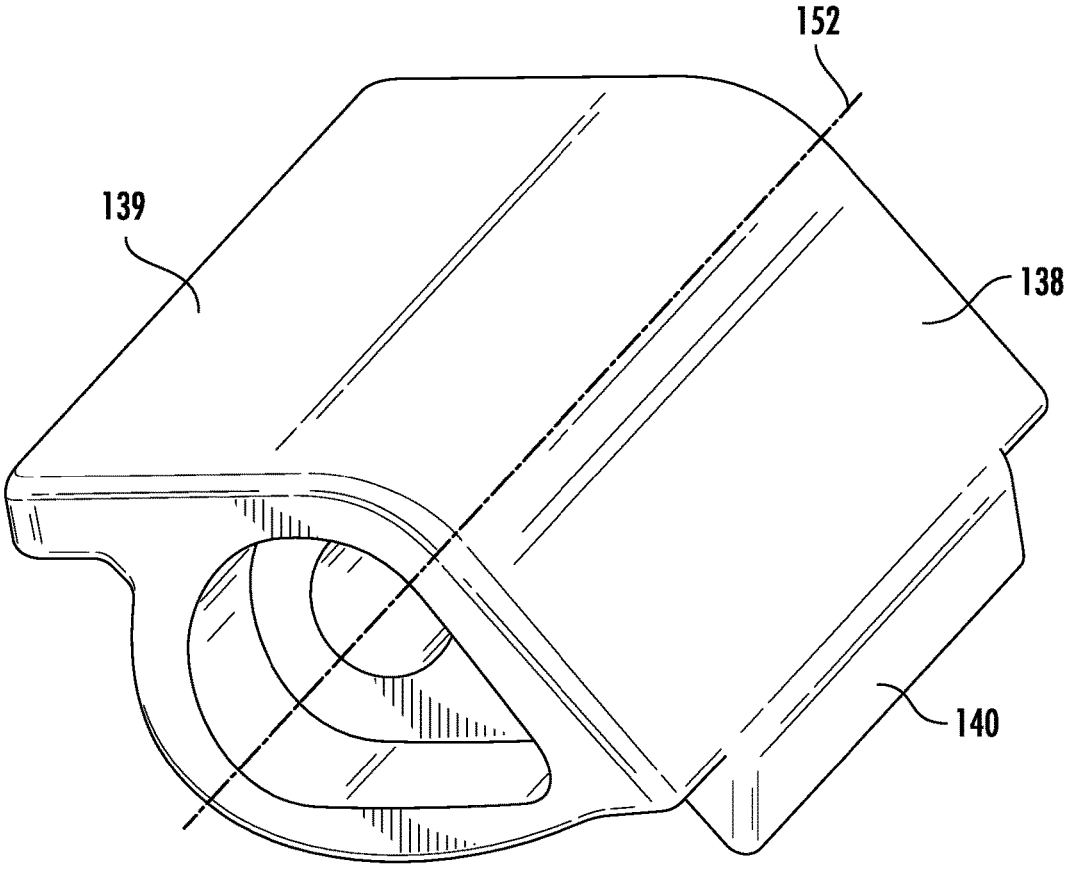
FIG. 7 is an isometric view of a tooth lock of an embodiment of the quick release toolbelt.
Figure 8:
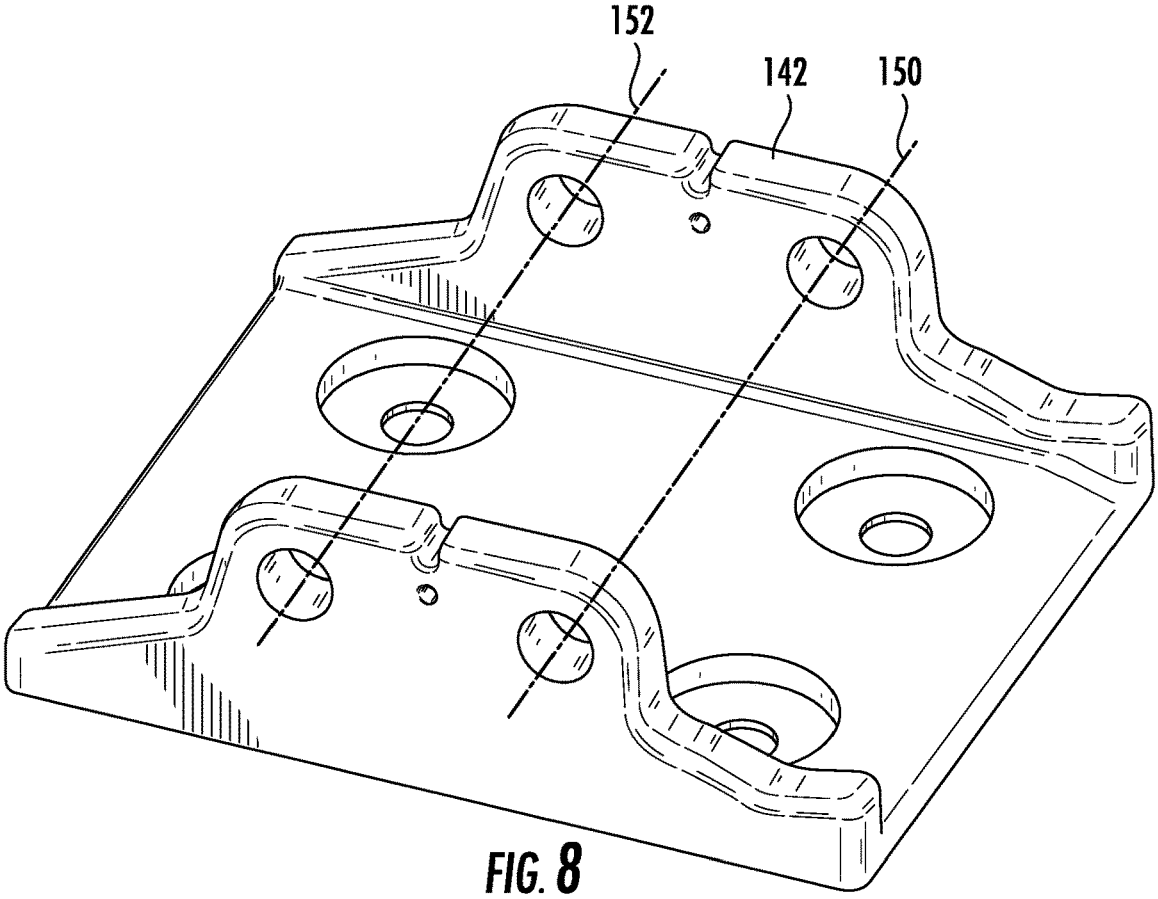
FIG. 8 is an isometric view of a base of the binding of an embodiment of the quick release toolbelt.
Figure 9:
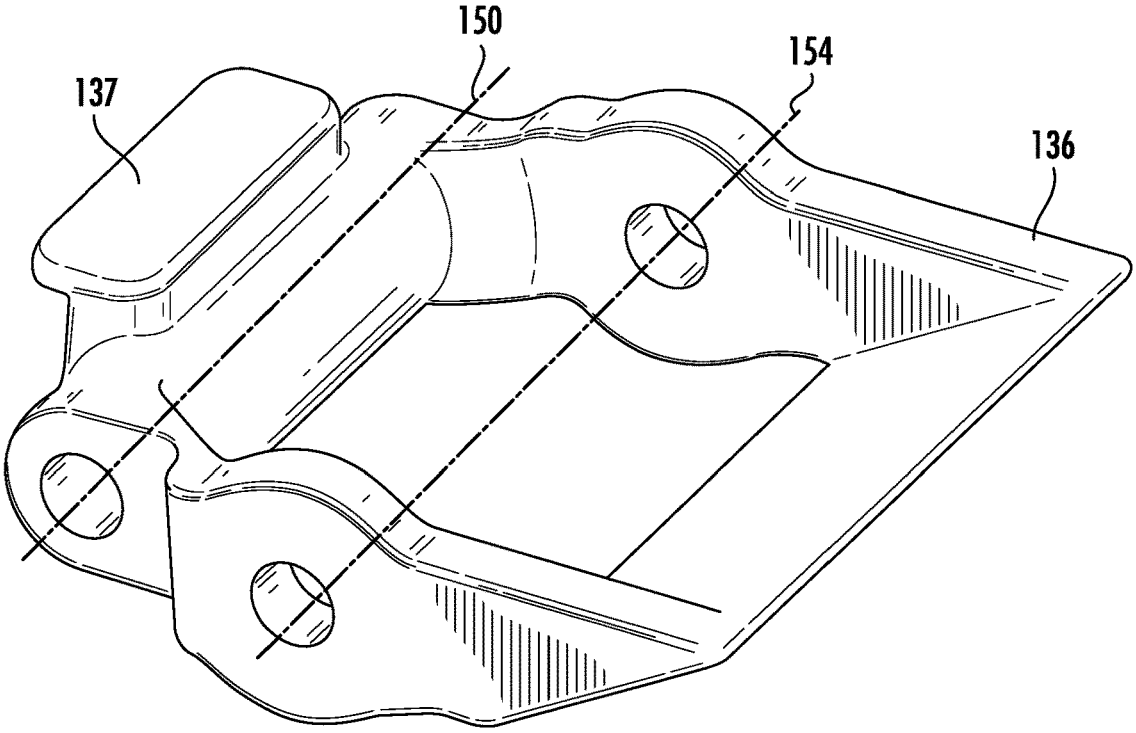
FIG. 9 is an isometric view of a release of an embodiment of the quick release toolbelt.

Similarly to the embodiment of FIGS. 4A-C, in order to tighten the belt incrementally, a user may pull the lever 132 away from the belt 18. This rotates the tightening lever 132 about an axis 154 from a first or home position to a second or tightening position. There may be at least one tightening tooth or teeth 160 engaged with the belt 18, and as the lever 132 is rotated, the tooth or teeth 160 force the tightening mechanism 130 in a direction J as shown in FIG. 5. The tooth lock 140 is allowed to slide over the teeth 40 on the belt 18 in this direction, and lock in place each time the tooth lock 140 is rolled over each of the teeth 40. The re-locking action is caused by a spring (not shown) or other biasing mechanism between the tooth lock 140 and the base 142 that urges the tooth lock into engagement. This allows for a high level of precision in tightening the belt, as opposed to the lack of precision on a standard belt which may be 1" or more between belt holes. It also allows for a user to quickly and accurately define the tightness of the belt that is needed at any given time without needed to remember which holes on a standard belt were used before, and without the overtightening that is necessary to ensure that the belt prongs meet with the holes together on initial fitting.

A base part 142 may be attached to the belt 12A. This attachment may be in any manner known in the art, such as rivets or the like. The tooth coupling may be rotationally attached to the base 142 at axis 152. This attachment may be a rivet, a nut and bolt, or any other attachment known in the art that allows for relative rotational movement. There may be a spring (not shown) or other biasing mechanism that urges the tooth coupling into engagement with the belt 18. As the release is rotated to a second or release position, it may be returned to the home position by the spring.

The release 136 may be attached to the base 142 at axis 150. This attachment may be a rivet, a nut and bolt, or any other attachment known in the art that allows for relative rotational movement. The release 136 may be urged into a first or home position by a spring (not shown) or other biasing member, or may be urged by the engagement between the tooth coupling shelf 139 which is biased by its own spring, and the pawl 137.

The tightening lever 132 may be attached to the release 136 at axis 154. This attachment may be a rivet, a nut and bolt, or any other attachment known in the art that allows for relative rotational movement. The lever 132 may be urged into a first or home position by a spring (not shown) or other biasing member between the lever 132 and the release 136. As the lever is rotated to a second or tightening position, the lever is returned to the home position by the spring.

The material of the components of the binding may be any material suited to handle the loads that will be introduced to the binding 130 by the release band 18 when a full load of tools in attached to the belt. A full load of tools may be 30-50 lbs, or even more in some circumstances. The material may be steel, aluminum, a plastic such as a glass-filled nylon, or other plastic or any other material that may be suited to the loads. Depending on the material chosen, the dimensions of the components may need to be larger or smaller. For instance, with a plastic lever 132 and belt 18, the width of the teeth 160 and belt teeth 40 may need to be greater than the width of steel teeth 160 and 40, in order to handle to loads presented. Further, the materials may be in combination, for instance a plastic lever 132 over-molded onto steel or aluminum teeth 160. Similarly, the tooth coupling 138 and the tooth 140 dimensions may need to be larger for a plastic coupling 138 than other materials.

Although the disclosure has been described with reference to preferred embodiments, persons skilled in the art will recognize that changes may be made in form and detail without departing from the spirit and scope of the disclosed apparatus, systems and methods. For instance, persons skilled in the art will recognize the various suitable materials for the assembly, taking into account the specific application and required durability of the belt.

Although the disclosure has been described with reference to preferred embodiments, persons skilled in the art will recognize that changes may be made in form and detail without departing from the spirit and scope of the disclosed apparatus, systems and methods.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

What is claimed is:

1. A quick release belt comprising:

a support strap having a teeth end and a release end;

a release band comprising a plurality of belt teeth disposed at the teeth end; and a quick release binding comprising a release mechanism disposed at the release end and slidably coupled to the release band, the quick release binding comprising:

a base attached at the release end;

a release rotationally attached to the base and having an engaged position and a release position and comprising a tooth lock;

a tooth coupling rotationally attached to the base and operably engaged with the release and the release band; and a lever rotationally attached to the release and operably engaged with the release band, and comprising at least one tightening tooth;

wherein when the release is in the engaged position the tooth coupling and the lever are engaged with the release band; and wherein when the release is in the release position, the tooth coupling is operably engaged with the release and the tooth coupling and the lever are disengaged with the release band.

2. The quick release belt of claim 1, wherein the lever and tooth coupling allow for relative movement between the binding and the release band in a first direction and prevent relative movement between the binding and the release band in a second direction when the release is in the engaged position.

3. The quick release belt of claim 2, wherein the first direction is a tightening direction.

4. The quick release belt of claim 2, further comprising a spring operably coupled to the release and urging the release toward the engaged position.

5. The quick release belt of claim 2, wherein when the release is in the release position, the lever and tooth coupling allow for relative movement between the binding and the release band in the second direction.

6. The quick release belt of claim 2, wherein the tooth lock and the belt teeth are configured to allow slidable movement in the first direction, and prevent slidable movement in the second direction.

7. The quick release belt of claim 1, wherein the lever further comprises a first position and a second position relative to the release.

8. The quick release belt of claim 7, wherein when the lever is moved into the second position, the at least one tightening tooth engages at least one of the plurality of belt teeth and moves the binding relative to the release band in a tightening direction.

9. The quick release belt of claim 1, wherein the support strap is substantially C-shaped.

10. The quick release belt of claim 1, further comprising support padding.

11. The quick release belt of claim 10, wherein the support padding comprises a foam material.

12. The quick release belt of claim 1, further comprising a second support strap.

13. The quick release belt of claim 1, wherein the belt may be tightened without disengaging the binding from the release band.

14. The quick release belt of claim 13 wherein the belt may be loosened without disengaging the binding from the release band.

15. The quick release tool belt of claim 1, wherein the tool belt is capable of holding a plurality of tools that weigh at least 50 pounds.

16. A quick release belt system comprising:

a support strap having a release end with a release band, and a base end having a base coupled thereon;

a release rotationally attached to the base and having a locked position and an unlocked position and comprising a tooth lock;

a tooth coupling rotationally attached to the base and operably engaged with the release and the release band; and a lever rotationally attached to the release and operably engaged with the release band, and comprising at least one tightening tooth;

wherein when the release is in the locked position the tooth coupling and the lever are engaged with the release band and allow for slidable movement in a tightening direction and prevent movement in a loosening direction; and wherein when the release is in the unlocked position, the tooth coupling is operably engaged with the release and the tooth coupling and the lever are disengaged with the release band and allow for movement in both the tightening and loosening directions.

17. The quick release belt system of claim 16, wherein the quick release belt system may be tightened without disengaging the binding from the release band.

18. The quick release belt system 16, further comprising a second support strap.

19. The quick release belt system 16, further comprising support padding disposed between the support strap and a user.

20. A quick release belt for the waist of a user, comprising:

a support strap having a gripping end and a release handle end;

a release band comprising a plurality of belt teeth disposed at the gripping end; and a quick release binding comprising a release mechanism disposed at the release end and slidably coupled to the release band, the quick release binding comprising:

a base attached at the release handle end;

a release rotationally attached to the base and having an engaged position and a release position and comprising a tooth lock;

a tooth coupling rotationally attached to the base and operably engaged with the release and the release band; and a lever rotationally attached to the release and operably engaged with the release band, and comprising at least one tightening tooth;

wherein when the release is in the engaged position the tooth coupling and the lever are engaged with the release band and allow for relative movement between the binding and the release band in a first direction and prevent relative movement between the binding and the release band in a second direction when the release is in the engaged position; and wherein when the release is in the release position, the tooth coupling is operably engaged with the release and the tooth coupling and the lever are disengaged with the release band.

* * * * *